US006475970B1

(12) United States Patent
Del Duca et al.

(10) Patent No.: US 6,475,970 B1
(45) Date of Patent: Nov. 5, 2002

(54) BLEACHING COMPOSITION COMPRISING AN ALKOXYLATED BENZOIC ACID

(75) Inventors: Valerio Del Duca, Naples; Stefano Giunti, Pesaro; Milena Leone, Gallarate; Carlo Ricci, Rome; Luca Sarcinelli, Palermo, all of (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,608

(22) PCT Filed: Nov. 10, 1999

(86) PCT No.: PCT/US99/26605

§ 371 (c)(1),
(2), (4) Date: May 10, 2001

(87) PCT Pub. No.: WO00/27972

PCT Pub. Date: May 18, 2000

(51) Int. Cl.[7] ..... C11D 3/395; C11D 3/00; C11D 7/54; C11D 17/04; D06L 17/04

(52) U.S. Cl. ..... 510/375; 510/278; 510/302; 510/372

(58) Field of Search ..... 510/372, 375, 510/302, 278, 303

(56) References Cited

U.S. PATENT DOCUMENTS

| | | | |
|---|---|---|---|
| 5,510,047 | A | 4/1996 | Gabriel et al. |
| 5,545,349 | A | 8/1996 | Kurii et al. |

FOREIGN PATENT DOCUMENTS

| | | |
|---|---|---|
| EP | 668 345 A1 | 8/1995 |
| WO | WO 99/28427 | 6/1999 |

*Primary Examiner*—Yogendra N. Gupta
*Assistant Examiner*—John M Petruncio
(74) *Attorney, Agent, or Firm*—Jason J. Camp; Kim W. Zerby; Steven W. Miller

(57) ABSTRACT

The present invention relates to a liquid or solid bleaching composition comprising a peroxygen bleach and an alkoxylated benzoic acid or a salt thereof. This bleaching composition shows excellent immediate chemical stability and excellent chemical stability upon storage. Furthermore, the present invention relates to a process of treating a fabric and/or a process of treating a carpet.

23 Claims, No Drawings

BLEACHING COMPOSITION COMPRISING AN ALKOXYLATED BENZOIC ACID

TECHNICAL FIELD

The present invention relates to bleaching compositions, which can be used to treat various surfaces including, but not limited to, fabrics, clothes, carpets and the like as well as hard-surfaces like walls, tiles, floors, glass, bathrooms surfaces, kitchen surfaces, toilet bowls and dishes.

BACKGROUND OF THE INVENTION

Bleach-containing compositions for treating various surfaces, e.g., fabrics, carpets and the like, are well known in the art.

Peroxygen bleach-containing compositions have been extensively described in the art, especially in laundry applications as laundry detergents, laundry additives or laundry pretreaters, and in carpet treatment applications.

Indeed, it is known to use such peroxygen bleach-containing compositions in laundry and/or carpet treatment applications to boost the removal of dried on (encrusted) stains/soils and "problem" stains, such as grease, coffee, tea, grass, mud/clay-containing soils, which are otherwise particularly difficult to remove. In addition, peroxygen bleaches are considered as being safer to fabrics/carpets, specifically to coloured fabrics/carpets, compared to other bleaches, as for example hypohalite bleaches. However, peroxygen bleach-containing bleaching compositions have the inconvenience of being less stable compared to bleaching compositions based on other bleaches.

Indeed, a major problem associated with such peroxygen bleach-containing compositions, is their tendency to be unstable, especially upon storage, and more especially under conditions of elevated temperature. More particularly, it is believed that the peroxygen bleach ("oxidising agent") present in such bleaching composition can decompose resulting in a reduction of the concentration of oxidising agent over time ("loss of available oxygen"). Loss of available oxygen in such compositions consequently leads to the reduction of the cleaning and whitening performance of the compositions.

Bleaching compositions can be formulated comprising a radical scavenger in addition to the peroxygen bleach. It is believed that radical scavengers act as a bleach stabilizer in such bleaching compositions. Examples of such compositions known in the art, include bleaching compositions used to treat fabrics and/or hard-surfaces and comprising a peroxygen bleach and a radical scavenger, as e.g., butyl hydroxy toluene (BHT) and the like (EP-A-0 791 362, EP-A-0 842 604, EP-A-0 842 606 and EP-A-0 843 001) or carpet treatment compositions comprising a peroxygen bleach and a radical scavenger, e.g., n-propyl gallate or butyl hydroxy toluene (BHT) and the like (EP-A-0 906 950).

However, the stability of the peroxygen bleach in said bleaching compositions immediately after the manufacture of said bleaching composition ("immediate chemical stability") and the stability of the peroxygen bleach in said bleaching compositions upon prolonged periods of storage ("upon storage") may still be further improved.

It is therefore an objective of the present invention to provide a peroxygen bleach-containing composition, said composition being not only immediately chemically stable but also chemically stable upon storage, especially at higher temperatures.

It has now been found that this objective can be met by a bleaching composition comprising a peroxygen bleach and an alkoxylated benzoic acid.

Advantageously, the bleaching compositions as described herein also provide excellent bleaching performance.

More particularly, the compositions of the present invention provide excellent bleaching performance when used in any laundry application ("fabric treatment applications"), e.g., as a laundry detergent, a laundry additive and/or a laundry pretreater, and in carpet treatment applications.

A further advantage of the bleaching compositions according to the present invention is that they are able to perform in a variety of conditions, i.e., in hard and soft water as well as when used neat or diluted.

Yet another advantage of the bleaching compositions of the present invention is that said bleaching compositions are also suitable for the bleaching of different types of surfaces including hard-surfaces like floors, walls, tiles, glass, kitchen surfaces, bathrooms surfaces, toilet bowls and/or dishes and the like, in addition to the above mentioned fabric and carpet treatment applications. Furthermore, the bleaching compositions of the present invention are suitable for bleaching any type of fabrics/carpets including natural fabrics/carpets (e.g., fabrics/carpets made of cotton, viscose, linen, silk and wool), synthetic fabrics/carpets, such as those made of polymeric fibers of synthetic origin, as well as those made of both natural and synthetic fibers.

SUMMARY OF THE INVENTION

The present invention encompasses a bleaching composition comprising a peroxygen bleach and an alkoxylated benzoic acid or a salt thereof.

The present invention further encompasses processes of treating a surface, e.g., a fabric or a carpet, with a bleaching composition as defined herein.

DETAILED DESCRIPTION OF THE INVENTION

The Bleaching Composition

The bleaching compositions according to the present invention may be formulated either as solids or liquids. By "liquids" it is meant to include conventional liquids, gels and pastes. By "solids" it is meant herein granules, tablets and/or powders.

Solids are preferably applied onto the fabrics/carpets to be treated in combination with, preferably dissolved in, an appropriate solvent, typically water.

In the case where the bleaching compositions are formulated as liquids, the bleaching compositions are preferably, but not necessarily formulated as aqueous compositions. Liquid bleaching compositions are preferred herein for convenience of use. Preferred liquid bleaching compositions of the present invention are aqueous and therefore, preferably may comprise water, more preferably may comprise water in an amount of from 60% to 98%, even more preferably of from 80% to 97% and most preferably 85% to 97% by weight of the total composition.

The pH of the liquid bleaching compositions herein, as is measured at 25° C., preferably is at least, with increasing preference in the order given, 0.1, 0.5, 1, 1.5, 2, 2.5, 3, 3.5, 4, 4.5 or 5. Independently, the pH of the liquid bleaching compositions herein, as is measured at 25° C., preferably is no more than, with increasing preference in the order given, 9, 8.5, 8, 7.5, 7, 6.5, 6 or 5.5.

Solid bleaching compositions or liquid bleaching compositions herein have a pH measured at 25° C., preferably of at least, with increasing preference in the order given, 0.1, 0.5, 1, 1.5, 2, 2.5, 3, 3.5, 4, 4.5, 5, 5.5, 6, 6.5, 7, when diluted into 1 to 500 times its weight of water. Independently, solid bleaching compositions or liquid bleaching compositions herein have a pH measured at 25° C., preferably of no more than, with increasing preference in the order given, 12, 11.5, 11, 10.5, 10, 9.5, 9, 8.5 or 8, when diluted into 1 to 500 times its weight of water.

In a preferred embodiment the liquid compositions according to the present invention are formulated in the neutral to the acidic pH range. It is within this neutral to acidic pH range that the optimum chemical stability and bleaching and/or cleaning performance of the peroxygen bleach as well as fabric/carpet yellowing-prevention and/or safety are obtained.

Accordingly, the compositions herein may further comprise an acid or a base to adjust the pH as appropriate.

Preferred acids herein are organic or inorganic acids or mixtures thereof. Preferred organic acids are acetic acid, citric acid or a mixture thereof. Preferred inorganic acids are sulfuric acid, phosphoric acid or a mixture thereof. A particularly preferred acid to be used herein is an inorganic acid and most preferred is sulfuric acid.

Typical levels of such acids, when present, are of from 0.01% to 3.0%, preferably from 0.05% to 2.0% and more preferably from 0.1% to 1.0% by weight of the total composition.

The bases to be used herein can be organic or inorganic bases. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate and hydrogen carbonate.

Typical levels of such bases, when present, are of from 0.01% to 1.0%, preferably from 0.05% to 0.8% and more preferably from 0.1% to 0.5% by weight of the total composition.

Peroxygen Bleach

As a first essential element the bleaching compositions according to the present invention comprise a peroxygen bleach.

Suitable peroxygen bleaches to be used herein are selected from the group consisting of: hydrogen peroxide; water soluble sources of hydrogen peroxide; organic or inorganic peracids; hydroperoxides; diacyl peroxides; and mixtures thereof.

As used herein a hydrogen peroxide source refers to any compound that produces perhydroxyl ions on contact with water. Suitable water-soluble sources of hydrogen peroxide for use herein include percarbonates, perborates and persilicates and mixtures thereof.

Suitable diacyl peroxides for use herein include aliphatic, aromatic and aliphatic aromatic diacyl peroxides, and mixtures thereof.

Suitable aliphatic diacyl peroxides for use herein are dilauroyl peroxide, didecanoyl peroxide, dimyristoyl peroxide, or mixtures thereof. A suitable aromatic diacyl peroxide for use herein is for example benzoyl peroxide. A suitable aliphatic-aromatic diacyl peroxide for use herein is for example lauroyl benzoyl peroxide.

Suitable organic or inorganic peracids for use herein include: persulphates such as monopersulfate; peroxyacids such as diperoxydodecandioic acid (DPDA); magnesium perphthalic acid; perlauric acid; phthaloyl amidoperoxy caproic acid (PAP); perbenzoic and alkylperbenzoic acids; and mixtures thereof.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage of being particularly safe to fabrics and color while delivering excellent bleaching performance when used in any laundry application. Furthermore, such hydroperoxides have the advantage of being particularly safe to carpets and carpet dyes whilst delivering excellent bleaching performance when used in carpet treatment applications.

A preferred peroxygen bleach herein is selected from the group consisting of: hydrogen peroxide; water soluble sources of hydrogen peroxide; organic or inorganic peracids; hydroperoxides; and diacyl peroxides; and mixtures thereof. A more preferred peroxygen bleach herein is selected from the group consisting of hydrogen peroxide, water soluble sources of hydrogen peroxide and diacyl peroxides and mixtures thereof. An even more preferred peroxygen bleach herein is selected from the group consisting of hydrogen peroxide, water soluble sources of hydrogen peroxide, aliphatic diacyl peroxides, aromatic diacyl peroxides and aliphatic-aromatic diacyl peroxides and mixtures thereof. The most preferred peroxygen bleach herein is hydrogen peroxide, water soluble sources of hydrogen peroxide or mixtures thereof.

Preferably, the bleaching composition herein may comprise from 0.01% to 30%, preferably from 0.05% to 20%, more preferably from 0.1% to 15%, even more preferably from 0.15% to 10%, and most preferably from 0.2% to 10% by weight of the total composition of said peroxygen bleach.

The presence of a peroxygen bleach in bleaching compositions according to the present invention contributes to the excellent bleaching and/or cleaning performance on various types of soils including on spot stains like bleachable stains (e.g., coffee, beverage, food) of the compositions of the present invention.

Furthermore, peroxygen bleaches are chosen herein as oxidising agents over other oxidising agents, as for example hypohalite bleaches, as they are considered as being safer to fabrics/carpets, specifically to coloured fabrics/carpets.

By "bleachable stains" it is meant herein any soils or stains containing ingredients sensitive to bleach that can be found on any carpet, e.g., coffee or tea.

Alkoxylated Benzoic Acid

As a second essential ingredient the compositions according to the present invention comprise an alkoxylated benzoic acid or a salt thereof.

Generally, the alkoxylated benzoic acid or the salt thereof has the general formula:

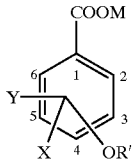

wherein: the substituents of the benzene ring X and Y are independently selected from —H, or —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety. Preferably, M is selected from the group consisting of hydrogen, alkali metal ions and alkaline earth metal ions. More preferably, M is selected from the group consisting of hydrogen, sodium and potassium. Even more preferably, M is hydrogen.

In a preferred embodiment of the present invention, said alkoxylated benzoic acid or the salt thereof is a monoalkoxy benzoic acid or a salt thereof, wherein in the above general formula : the substituents of the benzene ring X and Y are —H; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety. Preferably, said monoalkoxy benzoic acid or a salt thereof is selected from the group consisting of o-/m-/p-methoxy benzoic acids, salts thereof, and mixtures thereof. More preferably, said monoalkoxy benzoic acid or a salt thereof is m-methoxy benzoic acid (wherein the methoxy group is in position 3 in the above general formula) or a salt thereof.

In another preferred embodiment of the present invention, said alkoxylated benzoic acid or the salt thereof is a dialkoxy benzoic acid or a salt thereof, wherein in the above general formula: the substituent of the benzene ring X is selected from —H; the substituent of the benzene ring Y is —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety.

In still another preferred embodiment of the present invention, said alkoxylated benzoic acid or the salt thereof is a trialkoxy benzoic acid or a salt thereof, wherein in the above general formula: the substituents of the benzene ring Y and X are —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety.

Preferably, said alkoxylated benzoic acid or a salt thereof, is selected from the group consisting of: a monoalkoxy benzoic acid, or a salt thereof, a dialkoxy benzoic acid, or a salt thereof; a trialkoxy benzoic acid, or a salt thereof; and a mixture thereof. More preferably, said alkoxylated benzoic acid or a salt thereof, is selected from the group consisting of: a dialkoxy benzoic acid, or a salt thereof; a trialkoxy benzoic acid, or a salt thereof; and a mixture thereof. Even more preferably, said alkoxylated benzoic acid or a salt thereof, is a trimethoxy benzoic acid or a salt thereof.

In a highly preferred embodiment of the present invention, said alkoxylated benzoic acid or the salt thereof is a trimethoxy benzoic acid or a salt thereof (TMBA), wherein in the above general formula the substituents of the benzene ring Y and X are —OR'; R' is —$CH_3$ and; M is hydrogen, a cation or a cationic moiety.

Preferably, said alkoxylated benzoic acid or the salt thereof is selected from the group consisting of 3,4,5,-trimethoxy benzoic acid, a salt thereof, 2,3,4- trimethoxy benzoic acid, a salt thereof, 2,4,5- trimethoxy benzoic acid, a salt thereof and a mixture thereof. More preferably, said alkoxylated benzoic acid or the salt thereof is 3,4,5,- trimethoxy benzoic acid or a salt thereof. Even more preferably, said alkoxylated benzoic acid or the salt thereof is 3,4,5,- trimethoxy benzoic acid.

Suitable monoalkoxy benzoic acids or salts thereof are commercially available from Aldrich, in particular m-methoxy benzoic acid is commercially available from Aldrich. Suitable trimethoxy benzoic acids or salts thereof are commercially available from Aldrich and Merck.

Typically, the bleaching composition according to the present invention may comprise from 0.001% to 5%, preferably from 0.005% to 2.5% and more preferably from 0.01% to 1.0% by weight of the total composition of said alkoxylated benzoic acid or a salt thereof.

It has now been found that an alkoxylated benzoic acid or a salt thereof, preferably a trialkoxy benzoic acid or a salt thereof, more preferably trimethoxy benzoic acid or a salt thereof (TMBA), acts as a radical scavenger in the bleaching composition according to the present invention, thereby not only stabilizing the peroxygen bleach in said bleaching composition immediately after the manufacture of said bleaching composition ("immediate chemical stability benefit") but also stabilizing the peroxygen bleach in said bleaching composition upon storage ("chemical stability upon storage benefit"). Indeed, the presence of an alkoxylated benzoic acid or a salt thereof, preferably a trialkoxy benzoic acid or a salt thereof, more preferably trimethoxy benzoic acid or a salt thereof (TMBA), in said bleaching composition significantly increases the immediate chemical stability and particularly the chemical stability upon storage of the peroxygen bleach in said bleaching composition. Although not wishing to be bound by theory, it is believed that decomposition of the peroxygen bleach ("parent peroxygen bleach") and the interaction or reaction of the bleach with the other ingredients of the composition, as e.g., brighteners, surfactants, thickeners and the like, when present, proceeds via one electron chemistry. One electron chemistry reactions are initiated by the formation of free radicals from the parent peroxygen bleach. Generally, the radicals formed are more reactive and better oxidising species than the parent, accelerating the decomposition kinetics of the peroxygen bleach and its reaction or interaction with the other ingredients, when present in the composition. The result of such reactions is the decomposition of the peroxygen bleach and the other ingredients, when present. For example, where thickeners are components of the composition, decomposition thereof can be initiated by one electron processes, resulting in the loss or decrease of viscosity upon storage. To improve the immediate and/or storage stability of bleaching compositions and the compatibility of the peroxygen bleach with the other ingredients, when present, it is therefore important to reduce, slow down or preferably completely suppress one electron oxidation chemistry reactions. Alkoxylated benzoic acids or salts thereof, preferably trialkoxy benzoic acids or salts thereof, more preferably trimethoxy benzoic acid or a salt thereof (TMBA), have been found to exhibit an excellent performance in reduction, slowing down or complete suppression of said one electron oxidation chemistry reactions, particularly in peroxygen bleach-containing compositions.

Furthermore, it has been found that the "immediate chemical stability" and/or "the chemical stability upon storage" of the peroxygen bleach in the bleaching composition according to the present invention and/or the other actives ingredients therein (where present), is improved when an alkoxylated benzoic acid or a salt thereof, preferably a trialkoxy benzoic acid or a salt thereof, more preferably trimethoxy benzoic acid or a salt thereof (TMBA), is present versus when it is not or when another radical scavenger, as e.g., butyl hydroxy toluene (BHT), n-propyl gallate and the like, is present.

By "immediate chemical stability" it is meant herein, that the peroxygen bleach in bleaching compositions is stable immediately after the manufacture of said bleaching composition. By "chemical stability upon storage" it is meant herein, that the peroxygen bleach in bleaching compositions remains stable over a period of storage of 3 months at 25° C. Thus, in practice this means that a bleaching composition remains sufficiently stable throughout the use by the consumer.

Generally, the immediate chemical stability and chemical stability upon storage of the peroxygen bleach in a bleaching composition may be evaluated by measuring the concentration of available oxygen (often abbreviated to AvO2) immediately after and at given storage times after having manufactured the composition. The % loss of available oxygen and/or the concentration of remaining available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

Test Method for Chemical Stability Upon Storage

The chemical stability upon storage of the compositions according to the present invention may alternatively be assessed in the laboratory using a rapid ageing test ("RAT"). The RAT involves measuring the level of available oxygen in the fresh bleaching composition just after it is made and in the same composition after 7 days at 50° C. Under laboratory conditions, by "chemically stable upon storage", it is therefore to be understood that the compositions of the present invention typically do not undergo more than 25% loss of available oxygen (AvO2) at 50° C.±0.5° C. after 7 days of storage as compared to the level of available oxygen of the fresh compositions. More preferably not more than 20% loss of available oxygen at 50° C.±0.5° C. after 7 days of storage.

Furthermore, it has been found that certain radical scavengers other than alkoxylated benzoic acids or salts thereof, preferably other than trialkoxy benzoic acids or salts thereof, more preferably other than trimethoxy benzoic acid or a salt thereof (TMBA), as for example BHT, are themselves not completely chemically stable in bleaching compositions. Indeed, BHT can be present in a dimeric form in bleaching composition comprising a peroxygen bleach. Although not wishing to be bound by theory, it is believed that this dimeric form of BHT is formed by the interaction or reaction of BHT with radicals originating from the decomposition pathway of the peroxygen bleach and/or metal ions present in said bleaching compositions, especially when said BHT-containing bleaching composition is exposed to UV radiation (e.g., sunlight). The BHT dimer has a yellow color and therefore can lead to fabric and/or carpet yellowing when a bleaching composition comprising BHT is used to treat said fabric and/or carpet. It is believed that the fabric and/or carpet yellowing effect is due to the deposition of said BHT dimer formed during the storage of said bleaching composition and/or formed in-situ (on the fabric/carpet) during the treatment of said fabric and/or carpet with said bleaching composition. Moreover, the bleaching composition itself may turn yellow or at least get a yellowish color tone due to the presence of said yellow colored BHT dimer in said bleaching composition. In particular, the fabric/carpet yellowing and/or the bleaching composition yellowing may be observed when said fabric/carpet treated with a bleaching composition comprising BHT and/or said bleaching composition comprising BHT is exposed to light, for example direct sunlight, a UV lamp or the like, for a prolonged time, e.g., three to four hours.

It has now been found that alkoxylated benzoic acids or salts thereof, preferably trialkoxy benzoic acids or salts thereof, more preferably trimethoxy benzoic acid or a salt thereof (TMBA), itself are "substantially color stable", in bleaching composition as described herein.

By "substantially color stable" it is meant herein that substantially no coloured derivatives of alkoxylated benzoic acids or salts thereof, preferably trialkoxy benzoic acids or salts thereof, more preferably trimethoxy benzoic acid or a salt thereof (TMBA), are formed in the bleaching composition according to the present invention. Thus, preventing the yellowing of a fabric and/or a carpet when a bleaching composition comprising an alkoxylated benzoic acid or a salt thereof, preferably a trialkoxy benzoic acid or a salt thereof, more preferably trimethoxy benzoic acid or a salt thereof (TMBA), is used to treat said fabric and/or carpet ("fabric and/or carpet yellowing prevention benefit") and/or preventing the yellowing of the bleaching composition itself ("bleaching composition yellowing prevention benefit").

Therefore, the present invention encompasses the use of an alkoxylated benzoic acid or a salt thereof, preferably a trialkoxy benzoic acid or a salt thereof, more preferably trimethoxy benzoic acid or a salt thereof (TMBA), in a bleaching composition comprising a peroxygen bleach whereby a fabric and/or carpet yellowing prevention benefit and/or a bleaching composition yellowing prevention benefit is provided.

Test Method for Colour Stability

The yellowing of a fabric and/or a carpet when a bleaching composition is used to treat said fabric and/or carpet ("fabric and/or carpet yellowing") and/or the yellowing of the bleaching composition itself ("bleaching composition yellowing") can be assessed by visual grading. The visual grading may be performed by a group of expert panelists using panel score units (PSU). To asses the fabric and/or carpet yellowing prevention benefit of a given bleaching composition a PSU-scale ranging from 0, meaning no noticeable difference in yellowing of a treated fabric/carpet versus an untreated fabric/carpet, to 4, meaning a clearly noticeable difference in yellowing of a treated fabric/carpet versus an untreated fabric/carpet, can be applied. To asses the bleaching composition yellowing prevention benefit of a given bleaching composition a PSU-scale ranging from 0, meaning no noticeable difference in yellowing of a bleaching composition, to 4, meaning a clearly noticeable difference in yellowing of a bleaching composition, can be applied.

Optional Ingredients

Thickener

The compositions according to the present invention, preferably the compositions according to the present invention used in a process of treating a fabric, as described herein, may comprise as a highly preferred, but optional ingredient a thickener.

Preferred compositions of the present invention may have a viscosity of 1 cps or greater, more preferably of from 5 to 5000 cps, and still more preferably of from 10 to 2500 cps when measured with a $CSL^2100°$ Rheometer at 20° C. with a 4 cm spindle (linear increment from 10 to 100 dyne/$cm^2$ in 2 minutes).

Typically, the bleaching compositions according to the present invention may comprise from 0.001% to 10%, preferably from 0.05% to 5% and more preferably from 0.1% to 1.0% by weight of the total composition of a thickener.

Any thickener known to those skilled in the art are suitable for use herein. In a preferred embodiment the thickener is selected from the group consisting of: any suitable natural polymers and derivatives thereof, preferably polysaccharide polymers; vinyl-, carboxyvinyl-, crosslinked and non-crosslinked carboxylic-, preferably acrylic-, methacrylic- maleic- and the like, and acryloamido-polymers; fatty acid esters; silicates; idantoinic resins; pirogenic oxides; and mixtures thereof. More preferably, the thickener is a polysaccharide polymer, acrylic- or acryloamido-polymer or a mixture thereof. Even more preferably, the thickener is a polysaccharide polymer or a mixture thereof. Most preferably, the thickener is xanthan gum.

Suitable polysaccharide polymers for use herein include cellulose, substituted cellulose materials like carboxymethylcellulose, ethyl cellulose, hydroxyethyl cellulose, hydroxypropyl cellulose, hydroxymethyl cellulose, succinoglycan gum and naturally occurring polysaccharide polymers like xanthan gum, guar gum, locust bean gum, tragacanth gum or derivatives thereof, or mixtures thereof.

Particularly suitable thickeners for use herein are xanthan gum and derivatives thereof. Xanthan gum and derivatives thereof may be commercially available for instance from Kelco under the trade name Keltrol RD®, Kelzan S®, Kelzan ASX® or Keizan T®. Other suitable Xanthan gum are commercially available by Rhone Poulenc under the trade name Rhodopol T® and Rhodigel X747®. Succinoglycan gum for use herein is commercially available by Rhone Poulenc under the trade name Rheozan ®.

It has now been found, that alkoxylated benzoic acids or salts thereof, preferably trialkoxy benzoic acids or salts thereof, more preferably trimethoxy benzoic acid or a salt thereof (TMBA), reduce, slow down or preferably prevent the decomposition of a thickener, when present in the bleaching compositions according to the present invention ("rheological stability benefit"). Therefore, in the preferred embodiment wherein the compositions herein are thickened, meaning that the compositions have an increased viscosity, the presence of an alkoxylated benzoic acid or a salt thereof, preferably a trialkoxy benzoic acid or a salt thereof, more preferably trimethoxy benzoic acid or a salt thereof (TMBA), increases the rheological stability of the bleaching compositions according to the present invention upon storage.

Test Method for Rheological Stability Upon Storage

The rheological stability upon storage of the compositions according to the present invention may be assessed in the laboratory using a rapid ageing test ("RAT"). The RAT involves measuring the % loss of viscosity by comparing the viscosity of the fresh thickened bleaching composition ("initial viscosity") after it is made with the viscosity of the same compositions after 2 days at 50° C. Under laboratory conditions, by "rheological stability upon storage", it is therefore to be understood that the compositions of the present invention typically do not undergo more than 60% loss of viscosity at 50° C.±0.5° C. after 2 days of storage as compared to the initial viscosity of the fresh compositions. More preferably not more than 50% loss of viscosity at 50° C.±0.5° C. after 2 days of storage.

Surfactants

The compositions according to the present invention may comprise as a highly preferred but optional ingredient a surfactant.

The compositions of the present invention may further comprise a surfactant including nonionic surfactants, zwitterionic surfactants, anionic surfactants, cationic surfactants and/or amphoteric surfactants.

Typically, the compositions according to the present invention may comprise from 0.01% to 30%, preferably from 0.1% to 25% and more preferably from 0.5% to 20% by weight of the total composition of a surfactant.

Suitable nonionic surfactants include alkoxylated nonionic surfactants. Preferred alkoxylated nonionic surfactants herein are ethoxylated nonionic surfactants according to the formula $RO—(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants Preferred ethoxylated nonionic surfactants are substantially linear ethoxylated nonionic surfactants according to the above formula. By "linear" it is meant herein that the fatty alcohols used as a basis of the nonionic surfactant (raw material) at least 90%, preferably at least 95%, more preferably at least 97%, and most preferably 100% by weight of the total amount of fatty alcohols of linear (i.e., straight chain) fatty alcohols.

Suitable substantially linear ethoxylated nonionic surfactants for use herein are Marlipal® 24-7 (R is a mixture of linear $C_{12}$ and $C_{14}$ alkyl chains, n is 7), Marlipal® 24-4 (R is a mixture of linear $C_{12}$ and $C_{14}$ alkyl chains, n is 4), Marlipal® 24-3 (R is a mixture of linear $C_{12}$ and $C_{14}$ alkyl chains, n is 3), Marlipal® 24-2 (R is a mixture of linear $C_{12}$ and $C_{14}$ alkyl chains, n is 2), or mixtures thereof. Preferred herein are Marlipal® 24-7, Marlipal® 24-4, or mixtures thereof. These Marlipal® surfactants are commercially available from Condea.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture Of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7 R is a mixture of $C_9$ and $C_{11}$ alkyl chains, n is 8), Dobanol® 91-10 (HLB=14.2 R is a mixture of $C_9$ to $C_{11}$ alkyl chains, n is 10), Dobanol® 91-12 (HLB=14.5; R is a mixture of $C_9$ to $C_{11}$ alkyl chains, n is 12), or mixtures thereof. Preferred herein are Dobanol® 91-2.5, or Lutensol® TO3, or Lutensol® AO3, or Tergitol® 25L3, or Dobanol® 23-3, or Dobanol® 23-2, or Dobanol® 45-7, Dobanol® 91-8, or Dobanol® 91-10, or Dobanol® 91-12, or mixtures thereof. These Dobanole® surfactants are commercially available from SHELL. These Lutensol® surfactants are commercially available from BASF and these Tergitol® surfactants are commercially available from UNION CARBIDE. Suitable chemical processes for preparing the alkoxylated nonionic surfactants for use herein include condensation of corresponding alcohols with alkylene oxide, in the desired proportions. Such processes are well known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other suitable nonionic surfactants to be used herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_{1-4}$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_{1-4}$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$. In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is $C_1$–$C_4$ sulphonate group, or a $C_1$–$C_3$ alkyl and more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine $H_2C$—HA®.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below 50° C.) and $C_{16-18}$ alkyl chains are preferred for higher wash temperatures (e.g., above 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)SM), $C_{12}$–$C_{18}$ alkyl polyethoxylate (2.25) sulfate ($C_{12}$–$C_{18}$E(2.25)SM), $C_{12}$–$C_{18}$ alkyl polyethoxylate (3.0) sulfate ($C_{12}$–$C_{18}$E(3.0)SM), and $C_{12}$–$C_{18}$ alkyl polyethoxylate (4.0) sulfate ($C_{12}$–$C_{18}$E(4.0)SM), wherein M is conveniently selected from sodium and potassium.

Other suitable anionic surfactants for use herein are sulphonated anionic surfactants Suitable sulphonated anionic surfactants for use herein include alkyl sulphonates, alkyl aryl sulphonates, naphthalene sulphonates, alkyl alkoxylated sulphonates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{14}$–$C_{17}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{14}$–$C_{17}$ paraffin sulphonate like Hostapur ® SAS commercially available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

By "linear alkyl sulphonate" it is meant herein a non-substituted alkyl sulphonate wherein the alkyl chain comprises from 6 to 20 carbon atoms, preferably from 8 to 18 carbon atoms, and more preferably from 14 to 17 carbon atoms, and wherein this alkyl chain is sulphonated at one terminus.

Suitable alkoxylated sulphonate surfactants for use herein are according to the formula $R(A)_mSO_3M$ wherein R is an unsubstituted $C_6$–$C_{20}$ alkyl, hydroxyalkyl or alkyl aryl group, having a linear or branched $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy or butoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulphonate ($C_{12}$–$C_{18}$E(1.0) $SO_3M$), $C_{12}$–$C_{18}$ alkyl polyethoxylate (2.25) sulphonate ($C_{12}$–$C_{18}$E(2.25) $SO_3M$), $C_{12}$–$C_{18}$ alkyl polyethoxylate (3.0) sulphonate ($C_{12}$–$C_{18}$E(3.0) $SO_3M$), and $C_{12}$–$C_{18}$ alkyl polyethoxylate (4.0) sulphonate ($C_{12}$–$C_{18}$E(4.0) $SO_3M$), wherein M is conveniently selected from sodium and potassium. Particularly suitable alkoxylated sulphonates include alkyl aryl polyether sulphonate like Triton X-200® commercially available from Union Carbide.

Suitable $C_6$–$C_{20}$ alkyl alkoxylated linear or branched diphenyl oxide disulphonate surfactants for use herein are according to the following formula:

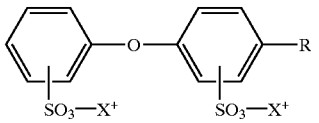

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants suitable herein include sulfosuccinate surfactants, alkyl carboxylate surfactants, sulfosuccinamate surfactants and sulfosuccinamide surfactants.

Suitable sulfosuccinate surfactants are according to the formula:

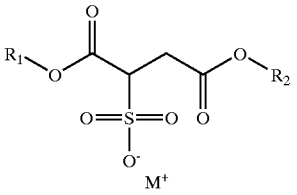

wherein: $R_1$ is hydrogen or a hydrocarbon group selected from the group consisting of straight or branched alkyl radicals containing from 6 to 20 carbon atoms, preferably 8 to 18 carbon atoms, more preferably 10 to 16 carbon atoms, and alkyl phenyl radicals containing from 6 to 18 carbon atoms in the alkyl group; $R_2$ is a hydrocarbon group selected from the group consisting of straight or branched alkyl radicals containing from 6 to 20 carbon atoms, preferably 8 to 18 carbon atoms, more preferably 10 to 16 carbon atoms, and alkyl phenyl radicals containing from 6 to 18 carbon atoms in the alkyl group; and M is hydrogen or a cationic moiety, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Such sulfosuccinate surfactants are commercially available under the tradenames Aerosol® from Cytec, Anionyx® from Stepan, Arylene® from Hart, Setacin® from Zschimmer & Schwarz, Mackanate® from McIntyre and Monawet® from Mona Industries.

Suitable sulfosuccinamate surfactants for use herein are according to the formula

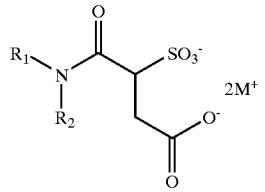

wherein $R_1$ and $R_2$ each independently represent a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable sulfosuccinamide surfactants for use herein are according to the formula

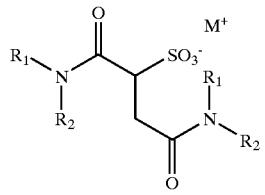

wherein $R_1$ and $R_2$ each independently represent a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl carboxylate surfactants for use herein are according to the formula $RCO_2M$ wherein: R represents a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Other anionic surfactants useful for detersive purposes can also be used herein. These can include salts (including, for example, sodium, potassium, ammonium, and substituted ammonium salts such as mono-, di- and triethanolamine salts) of soap, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulphonates such as $C_{14-16}$ methyl ester sulphonates; acyl glycerol sulphonates, fatty oleyl glycerol sulfates, alkyl phenol ethylene oxide ether sulfates, alkyl phosphates, isethionates such as the acyl isethionates, N-acyl taurates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued December 30, 1975, to Laughlin, et al. at Column 23, line 58 through Column 29, line 23 (herein incorporated by reference).

Other suitable anionic surfactants to be used herein also include acyl sarcosinate, in its acid and/or salt form, preferably long chain acyl sarcosinates having the following formula:

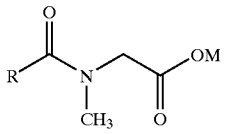

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein $R_1$ is an hydrocarbon chain comprising from 1 to 30 carbon atoms, preferably from 6 to 20, more preferably from 8 to 16, most preferably from 8 to 12, and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. $R_1$ may be a saturated substituted or unsubstituted linear or branched hydrocarbon chain. Suitable amine oxides for use herein are for instance natural blend $C_8$–$C_{10}$ amine oxides as well as $C_{12}$–$C_{16}$ amine oxides commercially available from Hoechst.

In a preferred embodiment of the present invention, more preferably in a preferred embodiment wherein the bleaching compositions according to the present invention are used in a process of treating a fabric as described herein, said compositions comprise a nonionic surfactant or a zwitterionic betaine surfactant or a mixture thereof.

In another preferred embodiment of the present invention, more preferably in a preferred embodiment wherein the bleaching compositions according to the present invention are used in a process of treating a fabric as described herein, said compositions comprise a sulphonated anionic surfactant. More preferably said composition further comprises a second surfactant selected from the group consisting of nonionic surfactants, amphoteric surfactants, zwitterionic surfactants and mixtures thereof.

In yet another preferred embodiment of the present invention, more preferably in a preferred embodiment wherein the bleaching compositions according to the present invention are used in a process of treating a carpet as described herein, said compositions comprise a sarcosinate surfactant, an alkyl sulphonate surfactant, an alkyl sulphate surfactant, or a zwitterionic betaine surfactant and mixtures thereof, and more preferably an alkyl sarcosinate surfactant.

In still another preferred embodiment of the present invention, more preferably in a preferred embodiment wherein the bleaching compositions according to the present invention are used in a process of treating a carpet as described herein, said compositions comprise a sulfosuccinate surfactant More preferably, said compositions comprise a mixture of a sulfosuccinate surfactant and a second anionic surfactant. Most preferably, said compositions comprise a mixture of a sulfosuccinate surfactant and a sulphate surfactant.

Other Optional Ingredients

The bleaching compositions herein may further comprise a variety of other optional ingredients such as builders, chelating agents, stabilisers, bleach activators, soil suspenders, soil suspending polyamine polymers, polymeric soil release agents, foam reducing systems or agents, catalysts, dye transfer agents, brighteners, perfumes, hydrotropes, solvents, pigments and dyes.

Builder

The bleaching compositions of the present invention may further comprise one or more builders and/or a modified polycarboxylate co-builder.

Suitable builders are selected from the group consisting of: organic acids and salts thereof; polycarboxylates; and mixtures thereof. Typically said builders have a calcium chelating constant (pKCa) of at least 3. Herein the pKCa the value of a builder or a mixture thereof is measured using an 0.1M $NH_4CI$—$NH_4OH$ buffer (pH 10 at 25° C.) and a 0.1% solution of said builder or mixture thereof with a standard calcium ion electrode.

Examples of builders are organic acids like citric acid, lactic acid, tartaric acid, oxalic acid, malic acid, monosuccinic acid, disuccinic acid, oxydisuccinic acid, carboxymethyl oxysuccinic acid, diglycolic acid, carboxymethyl tartronate, ditartronate and other organic acid or mixtures thereof.

Suitable salts of organic acids include alkaline, preferably sodium or potassium, alkaline earth metal, ammonium or alkanolamine salts.

Such organic acids and the salts thereof are commercially available from Jungbunzlaur, Haarman & Reimen, Sigma-Aldrich or Fluka.

Other suitable builders include a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Useful polycarboxylates include homopolymers of acrylic acid and copolymers of acrylic acid and maleic acid.

Other useful polycarboxylate builders include the ether hydroxypolycarboxylates, copolymers of maleic anhydride with ethylene or vinyl methyl ether, 1,3,5-trihydroxy benzene-2,4,6-trisulfonic acid, and carboxymethyloxysuccinic acid, the various alkali metal, ammonium and substituted ammonium salts of polyacetic acids such as nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Suitable polycarboxylates are commercially available from Rohm & Haas under the trade name Norasol® or Acusol®.

Preferred builders herein are selected from the group consisting of: citric acid; tartaric acid; tartrate monosuccinate; tartrate disuccinate; lactic acid; oxalic acid; and malic acid; and mixtures thereof. Even more preferred builders herein are selected from the group consisting of: citric acid; tartaric acid; tartrate monosuccinate; tartrate disuccinate; and malic acid; and mixtures thereof. The most preferred builders herein are selected from the group consisting of: citric acid; tartaric acid; tartrate monosuccinate; and tartrate disuccinate; and mixtures thereof.

Typically the bleaching compositions herein may comprise up to 40%, preferably from 0.01% to 25%, more preferably from 0.1% to 15%, and most preferably from 0.5% to 10% by weight of the total composition of said builder.

The compositions of the present invention may further comprise a modified polycarboxylate co-builder.

The term "polycarboxylate" refers to compounds having a plurality of carboxylate groups, preferably at least 3 carboxylates.

By "modified polycarboxylate" it is meant herein that at least at one end of the polycarboxylate compound, i.e., the polycarboxylate chain, said compound is modified by a functional group, e.g., a phosphono group.

Preferred modified polycarboxylate co-builders are polycarboxylates with phosphono end groups.

By "phosphono end group" it is meant herein a phosphono functional group according to the formula.

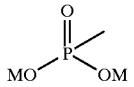

wherein each M is independently H or a cation, preferably both M are H.

Examples of suitable polycarboxylates with phosphono end groups are copolymers of acrylic acid and maleic acid having a phosphono end group and homopolymers of acrylic acid having a phosphono end group.

A preferred modified polycarboxylate is a copolymer of acrylic acid and maleic acid with a phosphonic/phosphono end group according to the general formula:

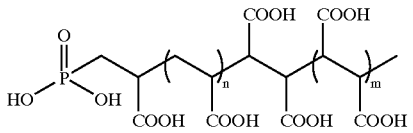

having an average molecular weight of from 1000 to 100000, preferably an average molecular weight of from 1000 to 20000, more preferably an average molecular weight of from 1000 to 10000, and most preferably an average molecular weight of from 1500 to 5000; wherein n is from 10 mol % to 90 mol %, preferably 80 mol % and m is from 10 mol % to 90 mol %, preferably 20 mol %.

Accordingly, an example of a suitable modified polycarboxylate is a copolymer of acrylic acid and maleic acid (80/20) with a phosphonic/phosphono end group according to the formula:

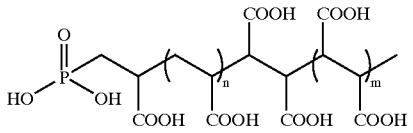

wherein n is 80 mol % and m is 20 mol %; having an average molecular weight of 2000.

Such modified polycarboxylate are available from Rohm & Haas under the trade name Acusol 425®, Acusol 420® or Acusol 470®.

Typically the bleaching compositions herein may comprise up to 40%, preferably from 0.01% to 25%, more preferably from 0.1% to 15%, and most preferably from 0.5% to 5% by weight of the total composition of said modified polycarboxylate co-builder.

Chelating Agents

The bleaching compositions of the present invention may comprise a chelating agent as a preferred optional ingredient. Suitable chelating agents may be any of those known to those skilled in the art, such as the ones selected from the group comprising phosphonate chelating agents, amino carboxylate chelating agents, other carboxylate chelating agents, polyfunctionally-substituted aromatic chelating agents, ethylenediamine N,N'- disuccinic acids, or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry through the wash application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'- disuccinic acid, or alkali metal, or alkaline earth, ammonium or substitutes ammonium salts thereof or mixtures thereof. Ethylenediamine N,N'- disuccinic acids, especially the (S,S) isomer, have been extensively described in U.S. Pat. No. 4,704,233, Nov. 3, 1987, to Hartman and Perkins. Ethylenediamine N,N'- disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

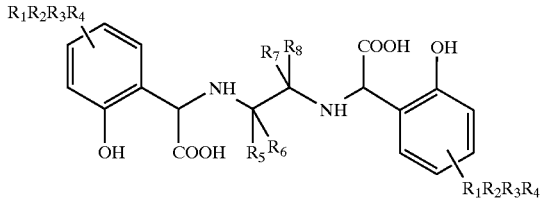

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N, N'-disuccinic acid, and mixtures thereof.

Typically, the bleaching compositions according to the present invention may comprise up to 5%, preferably from 0.01% to 1.5% by weight and more preferably from 0.01% to 0.5% by weight of the total composition of a chelating agent.

Solvents

The bleaching compositions according to the present invention may further comprise a solvent.

Preferred solvents herein include hydrophobic solvents, hydrophilic solvents and mixtures hereof.

To define the hydrophilic or hydrophobic character of a solvent herein, the following hydrophilic index (HI) is used:

$$\frac{\text{molecular weight of the hydrophilic part of the solvent}}{\text{total molecular weight of the solvent}} * 100$$

By "hydrophilic part" of a given solvent it is meant herein all the groups O, CO, OH, of a given solvent.

By "molecular weight of the hydrophilic part of a solvent" it is meant herein the total molecular weight of all the hydrophilic parts of a given solvent.

The hydrophilic solvents to be used herein have a hydrophilic index of more than 18, preferably more than 25, and more preferably more than 30, and the hydrophobic solvents to the used herein have a hydrophilic index of less than 18, preferably less than 17 and more preferably 16 or less.

Suitable hydrophobic solvents to be used herein include paraffins, terpenes or terpene derivatives, as well as alkoxylated aliphatic or aromatic alcohols, aliphatic or aromatic alcohols, glycols or alkoxylated glycols, and mixtures thereof, all these solvents have a hydrophilic index of less than 18.

Suitable terpenes (hydrophilic index of 0) are mono-and bicyclic monoterpenes, especially those of the hydrocarbon class, which include the terpinenes, terpinolenes, limonenes and pinenes and mixtures thereof. Highly preferred materials of this type are d-limonene, dipentene, alpha-pinene and/or beta-pinene. For example, pinene is commercially available form SCM Glidco (Jacksonville) under the name Alpha Pinene P&F®.

Terpene derivatives such as alcohols, aldehydes, esters, and ketones which have a hydrophilic index of less than 18 can also be used herein. Such materials are commercially available as, for example, the α and β0 isomers of terpineol and linalool.

All type of paraffins (hydrophilic index of 0) can be used herein, both linear and branched, containing from 2 to 20, preferably from 4 to 10, more preferably from 6 to 8 carbon atoms. Preferred herein is octane. Octane is commercially available for example from BASF.

Suitable hydrophobic alkoxylated aliphatic or aromatic alcohols to be used herein are according to the formula R—$(A)_n$—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms, wherein A is an alkoxy group preferably an butoxy, propoxy and/or ethoxy group, and n is an integer of from 1 to 5, preferably 1 to 2. Suitable hydrophobic alkoxylated alcohol to be used herein is 1-methoxy-11-dodecanol (HI=15).

Suitable hydrophobic aliphatic or aromatic alcohols to be used herein are according to the formula R—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms. Suitable aliphatic alcohols to be used herein include linear alcohols like decanol (HI=7). Suitable aromatic alcohol to be used herein is benzyl alcohol (HI=16).

Suitable hydrophobic glycols to be used herein are according to the formula HO—$CR_1R_2$—OH wherein $R_1$ and $R_2$ are independently H or a $C_2$–$C_{10}$ saturated or unsaturated aliphatic hydrocarbon chain and/or cyclic hydrocarbon chain. Suitable glycol to be used herein is dodecaneglycol (HI=16).

Suitable hydrophobic alkoxylated glycols to be used herein are according to the formula R—$(A)_n$—$R_1$—OH wherein R is H, OH, a linear saturated or unsaturated alkyl of from 1 to 20, preferably from 2 to 15 and more preferably from 2 to 10 carbon atoms, wherein $R_1$ is H or a linear saturated or unsaturated alkyl of from 1 to 20, preferably from 2 to 15 and more preferably from 2 to 10 carbon atoms, and A is an alkoxy group preferably an ethoxy, methoxy, and/or propoxy group and n is from 1 to 5, preferably 1 to 2. Suitable alkoxylated glycol to be used herein is methoxy octadecanol (HI=11).

Particularly preferred hydrophobic solvents to be used herein include d-limonene, dipentene, alpha-pinene, beta-pinene, octane, benzyl alcohol, or mixtures thereof.

Suitable hydrophilic solvents to be used herein include alkoxylated aliphatic or aromatic alcohols, aliphatic or aromatic alcohols, glycols or alkoxylated glycols, and mixtures thereof, all these solvents having a hydrophilic index of more than 18.

Suitable hydrophilic alkoxylated aliphatic or aromatic alcohols to be used herein are according to the formula R—$(A)_n$—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms, wherein A is an alkoxy group preferably a butoxy, propoxy and/or ethoxy group, and n is an integer of from 1 to 5, preferably 1 to 2. Particularly suitable alkoxylated alcohols to be used herein include methoxy propanol (HI=37), ethoxy propanol (HI=32), propoxy propanol (HI=28) and/or butoxy propanol (HI=27).

Suitable hydrophilic aliphatic or aromatic alcohols to be used herein are according to the formula R—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms. Particularly suitable aliphatic alcohols to be used herein include linear alcohols like ethanol (HI=37) and/or propanol (HI=28).

Suitable hydrophilic glycols to be used herein are according to the formula HO—$CR_1$ $R_2$—OH wherein $R_1$ and $R_2$ are independently H or a $C_2$–$C_{10}$ saturated or unsaturated aliphatic hydrocarbon chain and/or cyclic hydrocarbon chain. Particularly suitable glycol to be used herein is propanediol (HI=45).

Suitable hydrophilic alkoxylated glycols to be used herein are according to the formula R—$(A)_n$—$R_1$—OH wherein R is H, OH, a linear saturated or unsaturated alkyl group of from 1 to 20, preferably from 2 to 15 and more preferably from 2 to 10 carbon atoms, wherein $R_1$ is H or a linear saturated or unsaturated alkyl group of from 1 to 20, preferably from 2 to 15 and more preferably from 2 to 10 carbon atoms, and A is an alkoxy group preferably an ethoxy, methoxy, and/or propoxy group and n is from 1 to 5, preferably 1 to 2. Particularly suitable alkoxylated glycols to be used herein is ethoxyethoxyethanol (HI=37).

Typically, the bleaching compositions according to the present invention may comprise up to 30%, preferably from 0.01% to 15%, more preferably from 0.1% to 10%, and most preferably from 0.5% to 5% by weight of the total composition of a solvent.

In a preferred embodiment wherein the compositions herein comprise a mixture of a hydrophobic solvent and a hydrophilic solvent the weight ratio of said hydrophobic solvent to said hydrophilic is from 1:20 to 1:1, more preferably from 1:14 to 1:2.

Solvents, when present, contribute to the excellent stain removal performance of

Foam Reducing Agent or System

The bleaching compositions according to the present invention may further comprise a foam reducing agent or a foam reducing system. Any foam reducing agents known to those skilled in the art are suitable for use herein. In a preferred embodiment a foam reducing system comprising a fatty acid together with a capped alkoxylated nonionic surfactant as defined herein after and/or silicone is used.

Typically, the bleaching compositions herein may comprise from $1\cdot10^{-4}$% to 10%, preferably from $1\cdot10^{-3}$% to 5% and more preferably from $1\cdot10^{-2}$% to 5% by weight of the total composition of a fatty acid.

Typically, the bleaching compositions herein may comprise from $1\cdot10^{-3}$% to 20%, preferably from $1\cdot10^{-2}$% to 10% and more preferably from $1\cdot10^{-2}$% to 5% by weight of the total composition of a capped alkoxylated nonionic surfactant as defined herein.

Typically, the bleaching compositions herein may comprise from $1\cdot10^{-5}$% to 5%, preferably from $1\cdot10^{-5}$% to 1% and more preferably from $1\cdot10^{-4}$% to 0.5% by weight of the total composition of a silicone.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{1\ 5}$ alkyl group;

wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat. No. 4,076,648, U.S. Pat. No. 4,021,365, U.S. Pat. No. 4,749,740, U.S. Pat. No. 4,983,316, EP 150 872, EP 217 501 and EP 499 364. The silicone compounds disclosed therein are suitable in the context of the present invention. Generally, the silicone compounds can be described as siloxanes having the general structure:

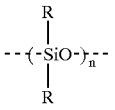

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e., a value of n in the range 40 to 1500. These are preferred because of their ready availability and their relatively low cost.

A preferred type of silicone compounds useful in the compositions herein comprises a mixture of an alkylated siloxane of the type herein above disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}m^2/s$ to 1 $m^2/s$. Preferred silicone compounds may have a viscosity in the range of from $5\times10^{-3}m^2/s$ to 0.1 $m^2/s$. Particularly suitable are silicone compounds with a viscosity of $2\times10^{-2}m^2/s$ or $4.5\times10^{-2}m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2–3597® both commercially available from Dow Corning.

Another silicone compound is disclosed in Bartollota et al. U.S. Pat. No. 3,933,672. Other particularly useful silicone compounds are the self-emulsifying silicone compounds, described in German Patent Application DTOS 2 646 126 published Apr. 28, 1977. An example of such a compound is DC-544®, commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil®.

Antioxidant

The bleaching compositions according to the present invention may further comprise an antioxidant.

Typically, the bleaching compositions herein may comprise up to 10%, preferably from 0.002% to 5%, more preferably from 0.005% to 2%, and most preferably from 0.01% to 1% by weight of the total composition of an antioxidant.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activator

As an optional ingredient, the compositions of the present invention may comprise a bleach activator. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene suiphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The bleaching compositions according to the present invention may comprise from 0.01% to 20%, preferably from 1% to 10%, and more preferably from 3% to 7% by weight of the total composition of said bleach activator.

Sulphonated Hydrotrope

The bleaching compositions according to the present invention may further comprise a sulphonated hydrotrope.

Any sulphonated hydrotropes known to those skilled in the art are suitable for use herein. In a preferred embodiment alkyl aryl sulphonates or alkyl aryl sulphonic acids are used, Preferred alkyl aryl sulphonates include sodium, potassium, calcium and ammonium xylene sulphonates, sodium, potassium, calcium and ammonium toluene sulphonates, sodium, potassium, calcium and ammonium cumene sulphonates, sodium, potassium, calcium and ammonium substituted or unsubstituted naphthalene sulphonates and mixtures thereof. Preferred alkyl aryl sulphonic acids include xylenesulphonic acid, toluenesulphonic acid, cumenesulphonic acid, substituted or unsubstituted naphthalenesulphonic acid and mixtures thereof. More preferably, xylenesulphonic acid or p-toluene sulphonate or mixtures thereof are used.

Typically, the bleaching compositions herein comprise from 0.01% to 20% by weight of the total composition of a sulphonated hydrotrope, preferably from 0.05% to 10% and more preferably from 0.1% to 5%.

Process of Treating Fabrics (Laundry Applications)

In the present invention, the bleaching composition of the present invention is used by applying the bleaching composition, preferably in a liquid form, to the fabric to be treated. By "in a liquid form" it is meant herein, the liquid compositions according to the present invention per se in neat or diluted form, as well as the granular or powder compositions or tablets according to the present invention that have been diluted with an appropriate solvent, typically water, before use, i.e., before being contacted to said fabrics.

The compositions according to the present invention are typically used in diluted form in a laundry operation. By "in diluted form" it is meant herein that the compositions for the bleaching of fabrics according to the present invention may be diluted by the user, preferably with water. Such dilution may occur for instance in hand laundry applications as well as by other means such as in a washing machine. Said compositions may be used at a dilution level of up to 1500:1 (solvent:composition), preferably from 5:1 to 1000:1 and more preferably from 10:1 to 700:1 (solvent:composition).

By "in its neat form", it is to be understood that the liquid bleaching compositions are applied directly onto the fabrics to be treated without undergoing any dilution, i.e., the liquid compositions herein are applied onto the fabrics as described herein.

Fabrics to be treated herein include, but are not limited to, clothes, curtains, drapes, bed linens, bath linens, table cloths, sleeping bags and/or tents.

By "treating a fabric", it is meant herein cleaning said and/or bleaching/disinfecting said fabric.

In the process of treating (e.g., cleaning and/or bleaching) a fabric, a bleaching composition according to the present invention is contacted with the fabrics to be treated.

This can be done either in a so-called "pretreatment mode", where a liquid bleaching composition, as defined herein, is applied neat onto said fabrics before the fabrics are rinsed, or washed, then rinsed, or in a "soaking mode" where a liquid or solid bleaching composition, as defined herein, is first diluted in an aqueous bath and the fabrics are immersed and soaked in the bath, before they are rinsed, or in a "through-the-wash mode", where a liquid or solid bleaching composition, as defined herein, is added in addition to a wash liquor formed by dissolution or dispersion of a typical laundry detergent, preferably in a washing machine. It is also essential in both cases, that the fabrics be rinsed after they have been contacted with said composition, before said composition has completely dried off.

More specifically, the process of bleaching fabrics according to the present invention preferably comprises the steps of first contacting said fabrics with a bleaching composition according to the present invention, then allowing said fabrics to remain in contact with said composition, for a period of time sufficient to bleach said fabrics, then rinsing said fabrics with water. If said fabrics are to be washed, i.e., with a conventional composition comprising at least one surface active agent, the washing of said fabrics with a detergent composition comprising at least one surface active agent may be conducted before the step of contacting said fabrics with said bleaching composition and/or in the step where said fabrics are contacted with said bleaching composition and/or after the step where said fabrics are contacted with the bleaching composition and before the rinsing step and/or after the rinsing step.

The bleaching composition may be used in dilute or neat form. Where it is used diluted, the bleaching composition should remain in contact with the fabric for typically 1 to 60 minutes, preferably 5 to 30 minutes. Whereas, when the bleaching composition is used in its neat form, it should remain in contact with the fabric for a much shorter time, typically 5 seconds to 30 minutes, preferably 1 minute to 10 minutes.

It is preferred to perform the bleaching process herein before said fabrics are washed, Indeed, it has been observed that bleaching said fabrics with the compositions according to the present invention (diluted and/or neat bleaching processes) prior to washing them with a detergent composition provides superior whiteness and stain removal with less energy and detergent than if said fabrics are washed first, then bleached.

Alternatively instead of following the neat bleaching process as described above (pretreatment application) with a rinsing step and/or a conventional washing step with a liquid or powder conventional detergent, the bleaching pretreatment operation may also be followed by the diluted bleaching process as described above either in bucket (hand operation) or in a washing machine.

Process of Treating Hard-Surfaces

In another embodiment the present invention also encompasses a process of treating a hard-surface. In such a process the hard-surfaces to be treated is contacted with a composition, as defined herein. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form. In the diluted form, the composition is preferably diluted with up to 200 times its weight of water, preferably 80 to 2 times its weight of water, and more preferably 60 to 2 times its weight of water.

When used as hard surfaces cleaners the compositions of the present invention are easy to rinse and provide good shine characteristics on the treated surfaces.

Depending on the end-use envisioned, the compositions herein can be packaged in a variety of containers including conventional bottles, bottles equipped with roll-on, sponge, brusher, sprayers, pouches, sachets, boxes, etc.

Process of Treating a Carpet

The present invention encompasses a process of treating a carpet comprising the application of a bleaching composition according to the present invention onto said carpet. Preferably, said bleaching composition is applied in its liquid form onto said carpet using a spraying device.

In a highly preferred embodiment of the present invention said composition is applied onto said carpet using an electrical spraying device.

In a preferred embodiment of the present application, said process comprises the steps of applying a liquid bleaching composition according to the present invention to the surface of the carpet and leaving said composition to substantially dry on the carpet. More preferably, said process of treating a carpet further comprises the step of removing said composition, even more preferably, said process of treating a carpet further comprises the step of removing said composition in combination with soil particles.

In another embodiment of the present application, said process comprises the steps of applying a liquid bleaching composition according to the present invention to parts, preferably heavily soiled parts, of the carpet, mechanically agitating the composition with an implement into the soiled parts of the carpet layer and leaving said composition to substantially dry on the carpet. More preferably said process of treating a carpet further comprises the step of removing said composition, even more preferably said process of treating a carpet further comprises the step of removing said composition in combination with soil particles. Any number of implements may be used to provide said mechanical agitation, including brushes, paper towels, a cleaning glove, a human finger and the like. Said mechanical agitation allows the liquid composition to better penetrate into the carpet fibers and thus improves the chemical cleaning action of said composition. In addition, said contact loosens the dirt particles forming the stain.

In a preferred process according to the present invention, a liquid bleaching composition according to the present invention is applied onto the carpet using a spraying device. Said spraying device is preferably a container that has at least one aperture through which the composition is dispensed to produce a spray of droplets.

Such a spraying device may comprise a means for delivering the composition by a pump ("pump spray dispenser") or may be operated by any source of pressurised gas such as an aerosol-can or a pressurizer. Pump spray dispensers may be manually or electrically, preferably electrically, operated. Said pump spray dispensers are particularly preferable if a large area is to be treated and/or if a high amount of product has to be applied onto a heavily stained area ("spot") of the carpet as they facilitate the ease of use by the consumer. Said pump spray dispensers ensure uniform coverage of the area to be treated.

Preferred spraying devices herein are manually or electrically operated pump spray dispensers. More preferred spraying devices herein are electrically operated pump spray dispensers.

Typical manually operated pump spray dispensers include push button operated or trigger operated pump spray dispenser.

A preferred electrically operated pump spray dispensers ("electrical spraying device") herein is a container wherein the means for delivering the composition comprises an electrically driven pump and a spray arm. Said spray arm is either extended or extendible and has at least one aperture so that in operation, the composition is pumped by said electrically driven pump from the container, through the spray arm to the aperture from which it is dispensed. It is preferred that the spray arm communicates with the container by means of a flexible connector. The spray arm may have at least one aperture located along its length. The spray arm makes it easier to control where the composition is sprayed, thereby increasing the accuracy with which the composition is applied. The electrically driven pump may be, for example, a gear pump, an impeller pump, a piston pump, a screw pump, a peristaltic pump, a diaphragm pump, or any other miniature pump. In a highly preferred embodiment the electrically driven pump for use herein is a gear pump with a typical speed between 6000 rpm and 12000 rpm. The electrically driven pump is driven by a means which typically produces a torque of between 1 and 20 mN.m such as an electric motor. The electric motor must in turn be provided with a power source. The power source may be either mains electricity (optionally via transformer), or it may be a throw-away battery or rechargeable battery. The spray arm may be rigidly extended. However such a spray arm can be difficult to store, and the spray arm is preferably extensible either by means of telescopic or foldable configuration.

In a highly preferred embodiment, the composition is applied onto the carpet in the form of a spray of droplets having a particle size distribution with a mean diameter D(v,0.9) of less than 1500 microns, preferably less than 1000 microns, more preferably of less than 750 microns, even more preferably less than 500 microns, and most preferably from 350 microns to 10 microns.

By "mean diameter D(v,0.9) of less than 1500 microns" for a droplet size distribution it is meant that 90% of the spray of droplets dispensed (expressed in volume unit) has a droplet diameter of less than 1500 microns. For instance, a D(v,0.9) of less than 1500 microns indicates that 90% of the total sprayed volume is dispensed with droplets whose diameter is less than 1500 microns.

The particle size distribution of a spray of droplets can be determined by following the procedure detailed herebelow:

A suitable test equipment is the Malvern Mastersizer S LongBed® with 1000 mm lens and a maximum particle size range of 3475 microns. The Malvern Mastersizer S LongBed® provides a 21 cm opening (between its lenses) to accommodate spray flow. In all readings at the Malvern®, the lens surface must remain free of spray contamination. In the present setup procedure, the distance from the aperture of the spray dispenser to the laser was fixed at 8 cm, this to minimize lens contamination. At 8 cm distance, the spray was directed to the laser beam to place the laser center to the spray cone. At least three readings have to be made for each composition sprayed to determine the particle size distribution of the spray of droplets. The electrically operated spraying devices to be used in the test according to the present invention is preferably a battery-operated system. If such a battery-operated system is used, a "Full charge test" is being performed, By "Full charge test" it is meant herein, that the current was held consistent by connecting the battery-operated spray dispenser to a 3.9 voltage direct current (vdc) from an external power supply, this ensures a constant spray force.

Any container adapted to deliver a spray of droplets as defined herein is suitable for use herein. Several modifications can be made to the conventional, single aperture, spray head to ensure that a spray of such droplets as required herein is formed.

The amount of the compositions for the treating of carpets according to the present invention applied will depend on the severity of the stain or soil. In the case of stubborn stains more than one application may be required to ensure complete removal of the stain.

The area to be treated by applying the compositions according to the present invention may be of any size. Indeed, parts of the carpets, a complete section and/or the whole carpet may be treated with the composition for treating of a carpet according to the present invention.

In a preferred embodiment, the liquid bleaching composition according to the present invention applied to the carpet is left to substantially dry. Typically, the composition is left to dry on the carpet for less than 2 hours, preferably less than 1 hour, more preferably less than 40 minutes, even more preferably from 1 to 30 minutes and most preferably from 1 to 20 minutes.

Preferably the step of leaving said composition to dry onto the carpet (drying step) can either be an "active drying step" or a "passive drying step". By uactive drying step" it is meant herein, performing an additional action to facilitate the evaporation of the volatile ingredients of the liquid composition as disclosed herein, preferably by heating the carpet and/or the liquid composition applied thereon, preferably heating by means of application of hot air, infrared radiation and the like. By "passive drying step" it is meant herein, evaporation of the volatile ingredients of the liquid composition as disclosed herein without performing further action.

By "substantially dry" it is meant herein the stage where at least 40%, preferably at least 60% of the initial amount of composition dispensed onto the carpet is lost due to evaporation.

The step of leaving the composition to dry on the carpet is of course performed under "normal temperature" and "normal humidity conditions". By "normal temperature conditions" it is meant herein, from 15° C. to 25° C., preferably from 20° C. to 25° C. By "normal humidity conditions" it is meant herein, from 40% RH (%-relative humidity) to 80% RH, preferably from 50% RH to 65% RH.

Indeed, said composition may be left to substantially dry until said composition combined with dirt forms substantially dry residues. Preferably, said composition, more preferably said substantially dry residues, are then removed from the carpet. Even more preferably said substantially dry residues are removed mechanically, as e.g., by brushing, sweeping beating, and/or by vacuum cleaning. This may be carried out with the help of any commercially available vacuum cleaner like for instance a standard Hoover® 1300W vacuuming machine.

According to the present invention the bleaching compositions herein may be used for the removal of stains and soils as well as of odors from carpets or hard wearing textiles and fabrics, e.g., upholstery. In addition, the compositions according to the present invention may be used to hygienise, disinfect and/or exterminate microinsects from carpets or hard wearing textiles and fabrics, e.g., upholstery, rugs, curtains.

The invention is further illustrated by the following examples.

EXAMPLES

The following examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention. Furthermore, the compositions X to XVI are comparative example compositions.

| Compositions | I | II | III | IV | V | VI | VII | VIII |
|---|---|---|---|---|---|---|---|---|
| Dobanol ® 23-3 | 2.0 | 1.0 | 1.0 | 2.0 | 1.5 | — | — | — |
| Dobanol ® 91-10 | 2.0 | 3.0 | — | — | — | 2.0 | 2.0 | — |
| Marlipal ® 24-7 | — | — | 3.0 | 2.0 | 2.0 | 2.0 | — | 1.0 |
| Marlipal ® 24-4 | — | — | — | — | 1.0 | 1.0 | 1.5 | 1.0 |
| Alkyl betaine | — | — | — | 1.0 | 2.0 | 1.0 | 2.0 | 1.5 |
| 3,4,5-TMBA | 0.1 | 0.3 | 0.5 | 0.1 | 0.05 | — | — | 0.1 |
| m-MBA | — | — | — | — | — | 0.3 | 0.1 | — |
| BHT | — | — | — | — | — | — | — | — |
| Hydrogen Peroxide | 6.0 | 7.0 | 8.0 | 6.0 | 7.0 | 8.0 | 6.0 | 7.0 |
| Citric acid | — | 1.0 | 2.0 | 1.0 | 2.0 | — | 2.0 | — |
| Norasol SP02N ® | 2.0 | 3.0 | 2.0 | 2.0 | — | 2.0 | 2.0 | 2.0 |
| Acusol 425 ® | 2.0 | 2.0 | 2.0 | 2.0 | 2.0 | 2.0 | — | 2.0 |
| Xanthan Gum | — | — | 0.2 | 0.5 | 0.2 | 0.1 | — | 0.2 |
| Water and minors | | | | up to 100% | | | | |

All examples have a pH of below 9

| Compositions | IX | X | XI | XII | XIII | XIV | XV | XVI |
|---|---|---|---|---|---|---|---|---|
| Dobanol ® 23-3 | — | 0.5 | 1.0 | — | — | — | — | — |
| Dobanol ® 91-10 | — | — | — | — | — | 3.0 | 2.0 | 5.0 |
| Marlipal ® 24-7 | 2.0 | 2.5 | 1.0 | 4.0 | 7.0 | 3.0 | 2.0 | 5.0 |
| Marlipal ® 24-4 | 1.0 | 0.5 | 1.0 | 1.0 | — | — | — | — |
| Alkyl betaine | 1.5 | 2.5 | 2.5 | 2.0 | 2.0 | 2.0 | 2.0 | 2.0 |
| 3,4,5-TMBA | 0.1 | — | — | — | — | — | — | — |

-continued

| Compositions | IX | X | XI | XII | XIII | XIV | XV | XVI |
|---|---|---|---|---|---|---|---|---|
| BHT | — | 0.2 | 0.1 | 0.1 | 0.2 | 0.1 | — | — |
| Hydrogen Peroxide | 8.0 | 6.0 | 7.0 | 8.0 | 6.0 | 7.0 | 8.0 | 7.0 |
| Citric acid | 1.0 | — | 1.0 | 2.0 | 2.0 | 1.0 | — | — |
| Norasol SP02N ® | 2.0 | 2.0 | — | 2.0 | 2.0 | 2.0 | 2.0 | 2.0 |
| Acusol 425 ® | 2.0 | 2.0 | 3.0 | 3.0 | — | 2.0 | 2.0 | 2.0 |
| Xanthan Gum | 0.1 | — | 0.5 | 0.2 | 0.1 | 0.5 | 0.5 | — |
| Water and minors | | | | | up to 100% | | | |

All examples have a pH of below 9

Dobanol® 23-3 is a $C_{12}$–$C_{13}$ EO3 nonionic surfactant commercially available from SHELL.

Dobanol® 45-7 is a $C_{14}$–$C_{15}$ EO7 nonionic surfactant commercially available from SHELL.

Dobanole 91-8 is a $C_9$–$C_{11}$ EO8 nonionic surfactant commercially available from SHELL.

Dobanol® 91-10 is a $C_9$–$C_{11}$ EO10 nonionic surfactant commercially available from SHELL.

Marlipal® 24-4 is a linear $C_{12}$–$C_{14}$ EO4 nonionic surfactant commercially available from Condea.

Marlipal® 24-7 is a linear $C_{12}$–$C_{14}$ EO7 nonionic surfactant commercially available from Condea.

Alkyl betaine is Lauryl di-methyl betaine commercially available by Hoechst under the trade name GENAGEN. LAB®.

Hydrogen Peroxide is commercially available from Ausimont.

Norasol SPO2N® is a polycarboxylate builder commercially available from Rohm & Haas.

Acusol 425® is a modified polycarboxylate co-builder commercially available from Rohm & Haas.

Capped Alcohol is PLURAFAC LF231® commercially available from BASF 3,4,5-TMBA is 3,4,5-trimethoxy benzoic acid commercially available from Aldrich.

m-MBA is m-methoxy benzoic acid commercially available from Aldrich.

What is claimed is:

1. A bleaching composition comprising a peroxygen bleach and an alkoxylated benzoic acid or a salt thereof.

2. A bleaching composition according to claim 1, wherein said peroxygen bleach is selected from the group consisting of: hydrogen peroxide; water soluble sources of hydrogen peroxide; organic or inorganic peracids; hydroperoxides; and diacyl peroxides; and mixtures thereof.

3. A bleaching composition according to claim 1, wherein said alkoxylated benzoic acid or salt thereof has the general formula:

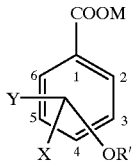

wherein the substituents of the benzene ring X and Y are independently selected from —H or —OR'; R' is independently selected from $C_1$ to $C_{20}$ linear or branched alkyl chains; and M is hydrogen, a cationic moiety, or a cation.

4. A bleaching composition according to claim 3, wherein the substituents of the benzene ring Y and X are —OR'; R' is independently selected from $C_1$ to $C_{20}$ linear or branched alkyl chains; and M is hydrogen, a cationic moiety, or a cation.

5. A bleaching composition according to claim 3, wherein the substituents of the benzene ring X and Y are —OR'; R' is —$CH_3$; and M is hydrogen, a cationic moiety, or a cation.

6. A bleaching composition according to claim 1, wherein said alkoxylated benzoic acid or a salt thereof is 3,4,5,-trimethoxy benzoic acid or a salt thereof.

7. A bleaching composition according to claim 1 in a liquid form, wherein said liquid bleaching composition has a pH, measured at 25° C., of no more than 9.

8. A bleaching composition according to claim 1 in a liquid or a solid form, wherein said liquid or solid bleaching composition, when diluted into 1 to 500 times its weight of water, has a pH, measured at 25° C., of no more than 12.

9. A bleaching composition according to claim 1, wherein said bleaching composition further comprises a thickener.

10. A bleaching composition according to claim 9, wherein said thickener is selected from the group consisting of: polysaccharide polymers; vinyl-, carboxyvinyl-, crosslinked and non-crosslinked carboxylic-, and acryloamido-polymers; fatty acid esters; silicates; idantoinic resins; pirogenic oxides; and mixtures thereof.

11. A bleaching composition according to claim 9, wherein said thickener is xanthan gum.

12. A bleaching composition according to claim 1 in a liquid form, wherein said bleaching composition has a viscosity of 1 cps or greater when measured with a $CSL^2$ 100® Rheometer at 20° C. with a 4 cm spindle (linear increment from 10 to 100 dyne/$cm^2$ in 2 minutes).

13. A bleaching composition according to claim 12 wherein said bleaching composition has a viscosity of from 5 to 5000 cps when measured with a $CSL^2$ 100® Rheometer at 20° C. with a 4 cm spindle (linear increment from 10 to 100 dyne/$cm^2$ in 2 minutes).

14. A bleaching composition according to claim 13 wherein said bleaching composition has a viscosity of from 10 to 2500 cps when measured with a $CSL^2$ 100® Rheometer at 20° C. with a 4 cm spindle (linear increment from 10 to 100 dyne/$cm^2$ in 2 minutes).

15. A bleaching composition according to claim 1, wherein said bleaching composition further comprises a surfactant.

16. A bleaching composition according to claim 15 wherein said surfactant is selected from the group consisting of nonionic surfactants, zwitterionic betaine surfactants, sulphonated anionic surfactants, sarcosinate surfactants, alkyl sulphate surfactants, sulfosuccinate surfactants and mixtures thereof.

17. A process of treating fabrics which comprises the step of contacting said fabrics with a bleaching composition according to claim 1, in a diluted form at a dilution level with water up to 1500 times.

18. A process of treating fabrics according to claim 17 which further comprises the steps of:

allowing said fabrics to remain in contact with said bleaching composition for a period of time sufficient to bleach said fabrics, then rinsing said fabrics in water to remove said bleaching composition.

19. A process according to claim 17, wherein said fabrics are washed with a detergent composition comprising at least one surface active agent before and/or during the contacting with the bleaching composition and/or after the rinsing when said bleaching composition has been removed.

20. A process of treating a fabric which comprises the steps of: contacting said fabric with a bleaching composition according to claim 1, in a neat, liquid form; allowing said fabric to remain in contact with said bleaching composition for a period of time sufficient to bleach said fabric; and rinsing said fabric in water to remove said bleaching composition.

21. A process according to claim 20, wherein said fabric is washed with a detergent composition comprising at least one surface active agent before the step of contacting said fabric with said bleaching composition and/or during the step of contacting said fabric with said bleaching composition and/or after the step of rinsing wherein said bleaching composition has been removed.

22. A process of treating a carpet comprising the step of applying a bleaching composition according to claim 1 onto said carpet.

23. A process of treating a carpet according to claim 22, wherein said bleaching composition is applied in a liquid form onto said carpet using a spraying device.

* * * * *